United States Patent [19]

Cromar et al.

[11] Patent Number: 5,002,131

[45] Date of Patent: Mar. 26, 1991

[54] CASING TENSIONING MECHANISM FOR A CASING HANGER

[75] Inventors: Stephen A. Cromar; Eric R. Schwelm; Garry Stephen, all of Aberdeen, Scotland

[73] Assignee: Vetco Gray Inc., Houston, Tex.

[21] Appl. No.: 466,985

[22] Filed: Jan. 18, 1990

[51] Int. Cl.[5] ..... E21B 43/10

[52] U.S. Cl. ..... 166/382; 166/208; 166/215

[58] Field of Search ..... 166/382, 387, 77.5, 166/124, 208, 214, 215, 217; 285/140

[56] References Cited

U.S. PATENT DOCUMENTS

| | | | |
|---|---|---|---|
| Re. 31,881 | 5/1985 | Lindsey, Jr. | 166/212 |
| 2,589,337 | 3/1952 | Burns | 166/215 X |
| 2,944,604 | 7/1960 | Baker | 166/137 X |
| 3,104,708 | 1/1963 | Orr et al. . | |
| 3,152,643 | 10/1964 | Burns | 166/208 X |
| 3,581,817 | 6/1971 | Kammerer, Jr. | 166/208 |
| 3,736,984 | 6/1973 | Garrett | 166/208 |
| 3,933,376 | 1/1976 | Cugini | 285/23 |
| 4,497,367 | 2/1985 | Stevenson | 166/215 X |
| 4,702,313 | 10/1987 | Greenlee et al. | 166/216 |
| 4,784,222 | 11/1988 | Ford | 166/217 X |
| 4,813,486 | 3/1989 | Wyatt et al. | 166/217 X |
| 4,823,871 | 4/1989 | McEver et al. | 166/182 |
| 4,825,954 | 5/1989 | Baugh | 166/382 |
| 4,949,787 | 8/1990 | Brammer et al. | 166/217 X |

*Primary Examiner*—William P. Neuder

[57] ABSTRACT

A mechanism mounts to a casing hanger for supporting the casing in tension. The mechanism includes a plurality of dogs mounted around the exterior of the casing hanger. Each of the dogs has wickers on its exterior which engage wickers formed in the bore of a wellhead housing. The dogs are carried within a recess. The recess has upper and lower parallel conical shoulders. A sleeve retains the dogs in a retracted position until tension has been applied. The sleeve releases the dogs by rotational movement of the running tool which runs the casing hanger.

6 Claims, 4 Drawing Sheets

CASING TENSIONING MECHANISM FOR A CASING HANGER

BACKGROUND OF THE INVENTION

1. Field of the Invention

This invention relates generally to wellhead equipment, and in particular to a mechanism for supporting a string of casing in tension within a well.

2. Description of the Prior Art

In an oil and gas well, one or more strings of casing will be cemented within the well. In one system used with offshore jack-up drilling rigs, the string of casing in the well will be supported by a mudline hanger located in a subsea housing at the sea floor. A section of the casing will extend upward to a surface wellhead housing on the drill rig. The surface wellhead housing will be located above the sea and below the rig floor. The distance from the subsea housing to the surface wellhead could be as much as 500 feet with a large jack-up drilling rig.

Cement will be pumped down the string to flow up the annulus to cement the casing in the well. The level of cement will be below the mudline hanger. In the prior art system, the casing will be cut off at the surface wellhead. The blowout preventer will be removed, and a spear will be used to pull tension on the casing after cementing. Then slips will be inserted around the casing which engage the wellhead housing and grip the casing to hold the casing in tension. A packoff will be installed between the casing hanger and the wellhead housing.

A disadvantage of the prior art system is that the blowout preventer must be removed while installing the slips and packoff. A danger of a blowout thus exists. Also, the prior art system is time consuming and expensive. In addition to this, the sealing mechanisms are generally elastomer or on site machined to give metal-to-metal seals.

SUMMARY OF THE INVENTION

In this invention, after cementing, dogs mounted to the exterior of the casing hanger will be released. Each of the dogs has a set of circumferential grooves or wickers on the exterior for engaging the wellhead housing. Preferably, the wellhead housing has a mating set of grooves or wickers. Springs urge the dogs outward.

The running tool for the casing hanger has a sleeve retainer. This retainer will hold the dogs in the retracted position during cementing. After cementing, rotating the running tool will begin to unscrew the running tool from the casing hanger. When this occurs, the sleeve will move upward, releasing the dogs to engage the wellhead housing.

Before the running tool completely releases, tension will be applied to the casing to the desired amount. The dogs will ratchet over the wickers in the wellhead housing as the casing hanger moves up while the tension is applied. The dogs will grip the wellhead housing, preventing the casing hanger from moving downward. The running tool and sleeve will then be removed from the wellhead housing.

DETAILED DESCRIPTION OF THE INVENTION

Referring to FIG. 1, wellhead housing 11 will normally be located above the sea on a jack-up drilling rig below the rig floor. Wellhead housing 11 has a bore 13. A set of grooves or wickers 15 will be formed on the bore 13. Wickers 15 are circumferential saw-tooth shaped teeth. Wickers 15 are parallel with each other and located in a plane perpendicular to the axis of the bore 13. The pitch of the wickers 15 is fairly small, typically about ⅛ inch.

Figure 1A:
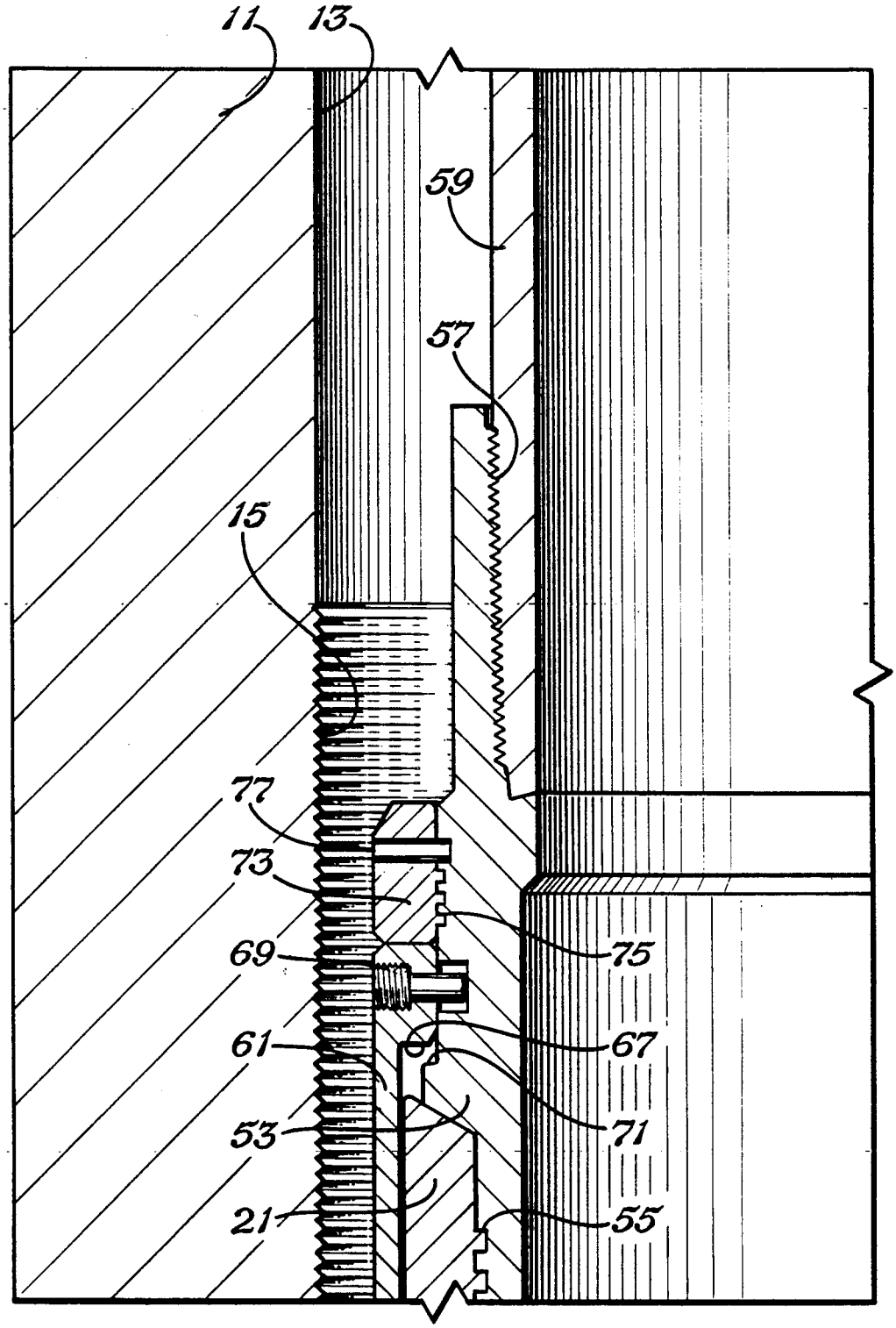
FIGS. 1*a* and 1*b* are a sectional view of a casing hanger running tool constructed in accordance with this invention, and shown in the running-in position.
Figure 1B:
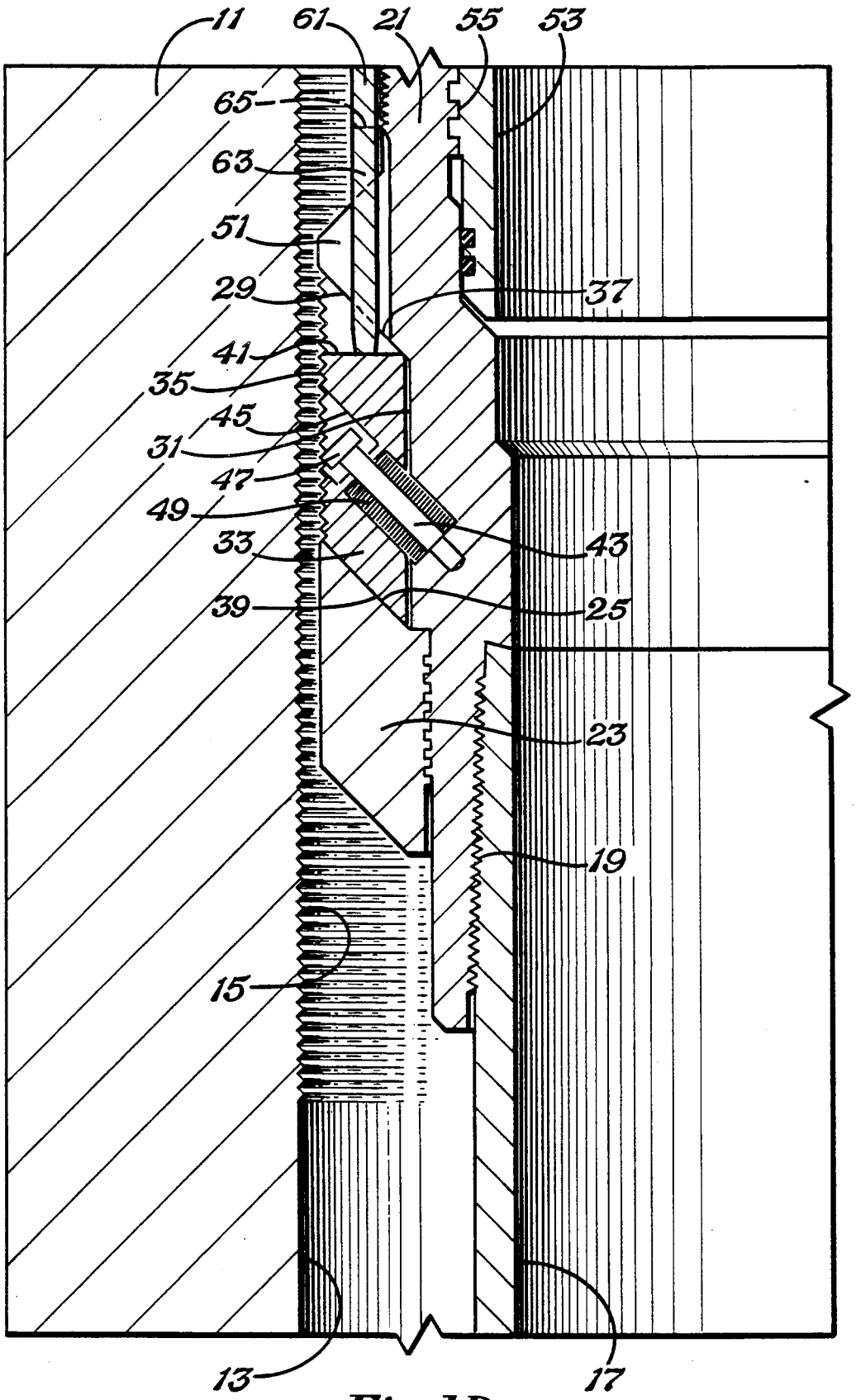

Referring to FIG. 1*b*, a string of casing 17 may be lowered into the well below the wellhead housing 11. The casing 17 will be supported by a mudline hanger in a subsea housing (not shown). There will not be any seal around the casing 17 at the mudline hanger. Rather, annulus pressure around the casing 17 will be sealed at the surface wellhead housing 11. The casing 17 will be cemented in the well, with the level of cement extending no higher than the subsea housing. The distance from the subsea housing to the surface wellhead housing 11 could be as much as 500 feet.

Figure 3:
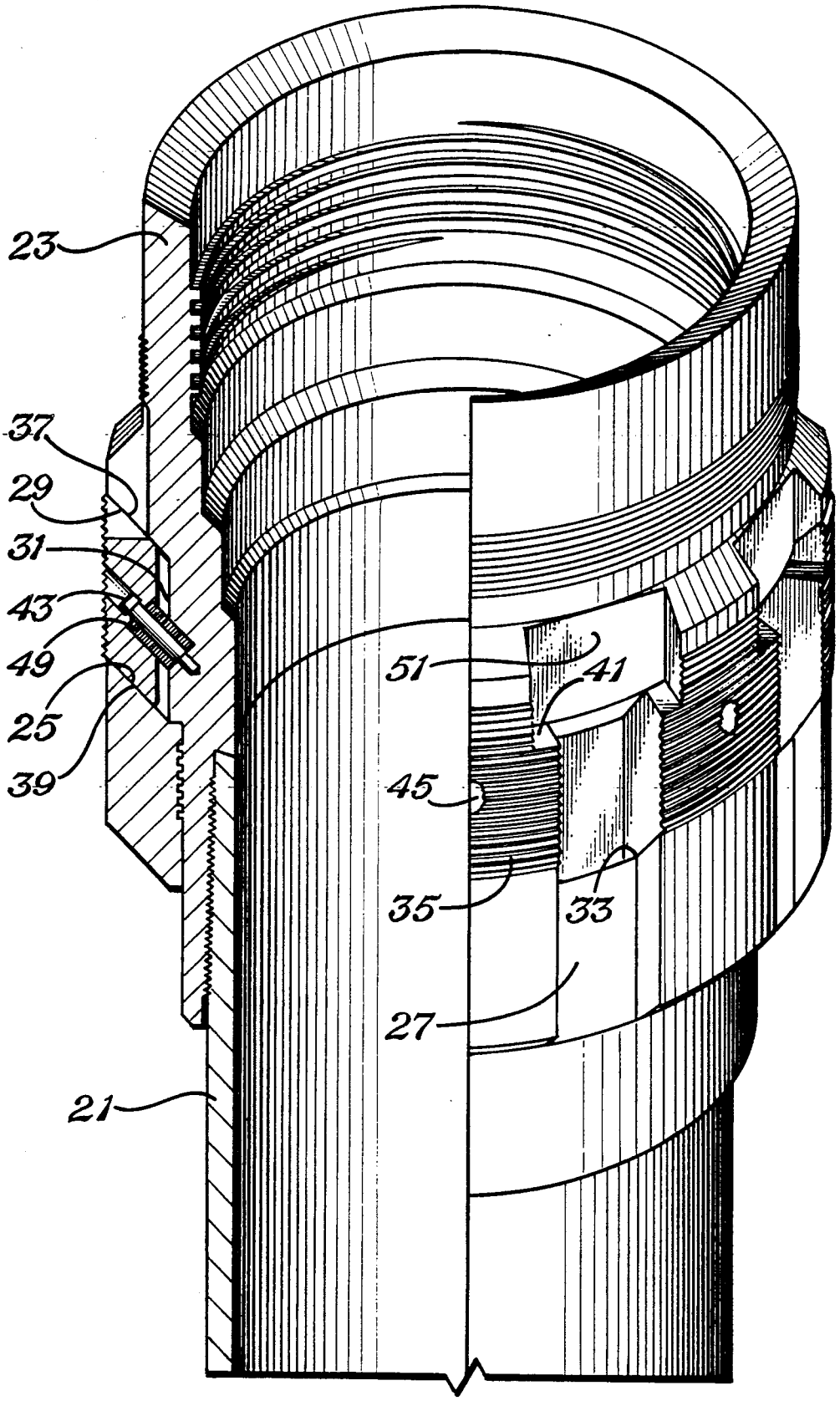
FIG. 3 is a perspective and partially sectioned view of the casing hanger of FIG. 1, shown with the sleeve and running tool removed.

Casing 17 secures by threads 19 to a casing hanger 21. Casing hanger 21 includes a collar 23 on its lower end. Collar 23 has an upward facing shoulder 25 on its upper end. Shoulder 25 is conical and straight when seen in vertical cross-section as shown in FIG. 1*b*. Shoulder 25 faces upward and inward. It inclines at an angle of about 45 degrees relative to the axis of bore 13. Collar 23 has vertical channels or flutes 27 formed in it and spaced circumferentially from each other as shown in FIG. 3.

Casing hanger 21 also has a downward facing shoulder 29 spaced above the upper facing shoulder 25. Downward facing shoulder 29 is conical and parallel to the upward facing shoulder 25. It faces downward and outward at an angle of 45 degrees relative to the axis of the bore 13. The shoulders 25, 29 define between them a recess 31.

A plurality of load carrying members or dogs 33 locate in the recess 31. The dogs 33 are spaced circumferentially around the exterior of casing hanger 21, as shown in FIG. 3. Dogs 33 are spaced apart from each other, leaving vertical spaces between them which align with the flutes 27. Each dog 33 is a segment of a cylinder. It has wickers 35 on its exterior which extend circumferentially. Wickers 35 have the same shape and size as the wickers 15 in the bore 13. The axial length of the dogs 33 is much less than the axial extent of the wickers 15 on the bore 13 of wellhead housing 11.

Figure 2:
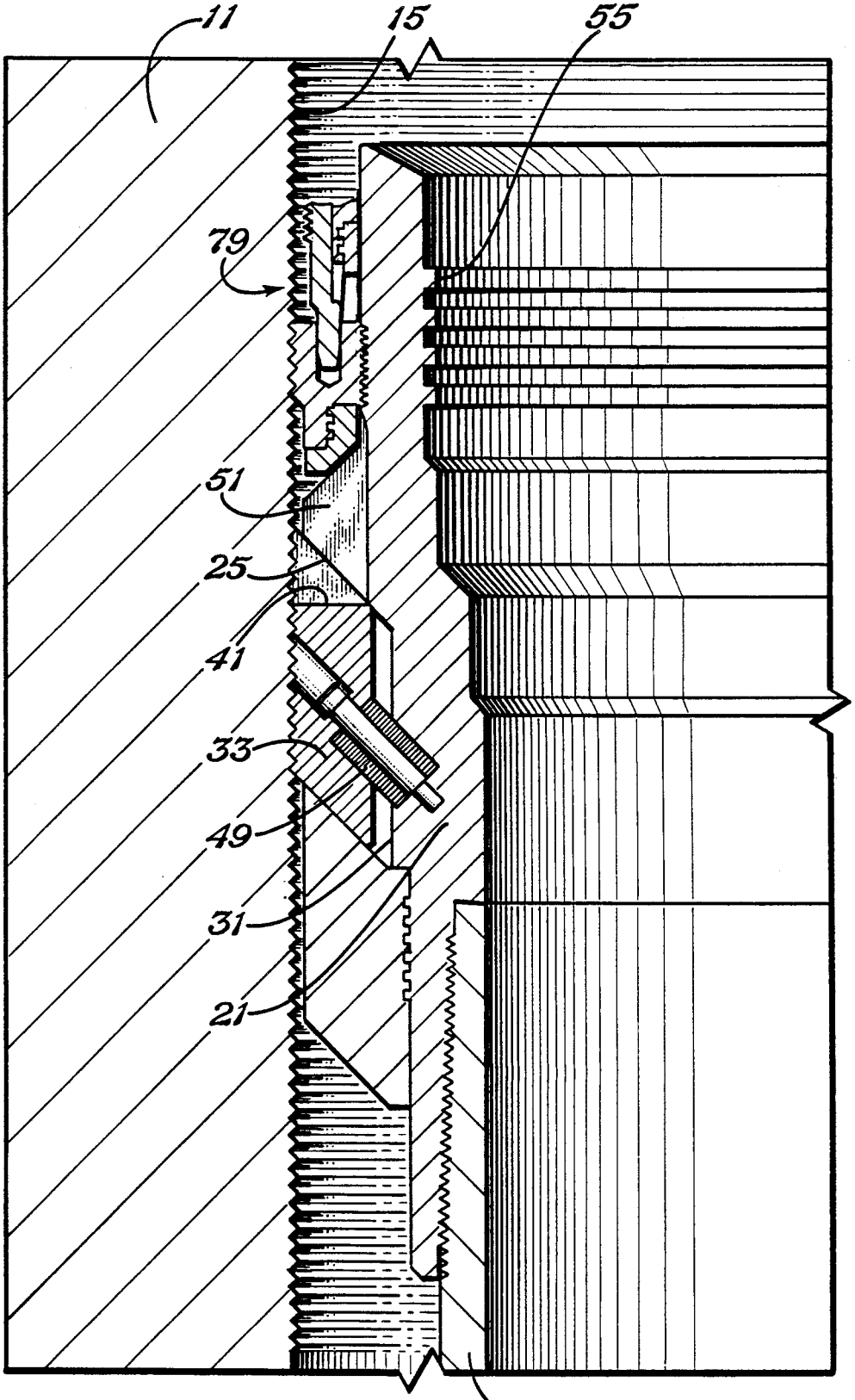
FIG. 2 is a view of the casing hanger of FIG. 1, shown with the running tool removed, a seal assembly installed, and with the load supporting dogs in an extended position.

Each dog 35 has an upper end 37 and a lower end 39. The upper end 37 is conical and faces upward and inward. It slidingly engages the downward facing hanger shoulder 29. Similarly, the lower end 39 of each dog 33 is conical and faces downward and outward. It slidingly engages the upward facing hanger shoulder 25. The inclinations of the upper and lower ends 37, 39 are the same as the inclinations of the shoulders 25, 29. Dogs 33 can slide from a retracted position shown in FIG. 1*b* to an extended position in FIG. 2. To slide to the extended position, the dogs 33 must slide upward and outward. In the retracted position, the back faces of the dogs 33 are closely spaced or even in slight contact with the cylindrical wall of the recess 31.

Each dog 33 also has a pair of upward facing shoulders 41 formed on each side, shown in FIG. 3. The shoulders 41 are formed perpendicular to the axis of the casing hanger 21. Each shoulder 41 is thus located at a 45 degree angle relative to the dog upper end 37.

A bolt 43 retains each dog 33 to the casing hanger 21. Bolt 43 extends through a hole 45. Bolt 43 is parallel to the upper and lower ends 37, 39. Bolt 43 has an enlarged head 47 that locates within an enlarged portion of the hole 45. Head 47 will bump against a shoulder within the hole 45 to prevent the dogs 33 from detaching from the casing hanger 21.

A number of Belleville springs 49 locate between the casing hanger 21 and each dog 33. Belleville springs 49 are conical steel washers. They will be placed opposite to each other, with concave sides facing each other, and convex sides facing each other, to provide an outward spring force when compressed. The Belleville springs 49 locate within enlarged portions of a hole within the casing hanger 21 and within the dogs 33. Belleville springs 49 provide a large outward force on the dogs 33 when the Belleville springs are compressed to the retracted position shown in FIG. 1*b*. The amount of movement between the retracted and extended position is exaggerated in the drawings and may be as little as one-eighth inch.

The casing hanger shoulder 29 has a number of vertical channels or flutes 51 formed through it, as shown more clearly in FIG. 3. Flutes 51 align with the flutes 27 and with the spaces between the dogs 33. Flutes 27 and 51 allow for the returns from cementing. Flutes 51 also provide access to the upward facing shoulders 41 on the dogs 33.

Referring to FIG. 1*a*, a running tool 53 will support the casing hanger 21 as it is lowered into the wellhead housing 11 and during cementing. Running tool 53 is a tubular member having exterior threads which engage threads 55 located in the interior of casing hanger 21. Running tool 53 has threads 57 on its upper end which secure to the lower end of a conduit 59, which may be part of a string of drill pipe or casing.

A sleeve 61 mounts to the running tool 53 and extends down the exterior of the casing hanger 21. As shown in FIG. 1*b*, sleeve 61 has a lower end containing a plurality of fingers 63. The dotted line 65 indicates the upper extremity of the fingers 63. Each finger 63 of a circumferential width that is slightly less than the circumferential width of the flutes 51 as shown in FIG. 3. Each finger 63 is formed by cutting slots out to accommodate the shoulder 29 and dog 33.

Each finger 63 will extend downward into the flutes 51 and into contact with shoulders 41 of adjacent dogs 33. The lower ends of the fingers 63 will contact the shoulders 41 as shown in FIG. 1*b*. This engagement keeps the dogs 33 from moving to the extended position, because to move to the extended position, the dogs 33 must move not only outward but also upward. The sleeve fingers 63 prevent the dogs 33 from moving upward Referring again to FIG. 1*a*, sleeve 61 has a lip 67 on its upper end that extends internally. A plurality of shear pins 69 pin the lip 67 to the running tool 53. Running tool 53 has an upward facing shoulder 71 located a short distance below the lip 67. After shear pins 69 shear, and when the running tool 53 moves up, the shoulder 71 will contact the lip 67 to pull the sleeve 61 upward.

A collar 73 retains the sleeve 61 on the running tool 53. Collar 73 has threads 75 for securing to the exterior of the running tool 53. A pin 77 prevents the collar 73 from accidentally unscrewing.

In operation, the casing 17 will be lowered into the well. Casing hanger 21 will be secured to the upper end of the casing 17. Running tool 53 will be secured to the casing hanger 21. The sleeve 61 will be pinned by shear pin 69 to the running tool 53. The fingers 63 of the sleeve 61 will engage the shoulders 41 of the dogs 33, keeping them in the retracted position. The lower end of a string of drill pipe 59 will be connected to the running tool 53. A mudline hanger (not shown) located in the string of casing 17 will land in the subsea housing (not shown). It will support the weight of the casing 17 in the well.

When the mudline hanger lands in the subsea housing, the dogs 33 will be located adjacent the wickers 15. Cement will then be pumped down the string of casing 17. The cement returns up the annulus surrounding the casing 17 to a selected level. Displaced drilling mud will flow up the annulus and through the flutes 27 and 51. Returns will also flow in the spaces between the dogs 33.

After the cement has been displaced, the casing 59 will be rotated a number of turns. The sleeve 61 cannot rotate relative to the casing hanger 21 because its fingers 63 are located in the spaces between the dogs 33. The complete assembly of running tool 53, casing hanger 21 and casing 17 will be rotated to open washout ports at the mudline casing hanger (not shown). Any residual cement may be washed out with returns up the annulus and through the flow by flutes 27, 51. After washout operations, the complete assembly of running tool 53, casing hanger 21, and casing 17 will be rotated to close the washout ports at the mudline.

Continued rotation will shear the shear pins 69. This causes the running tool 53 to partially unscrew from threads 55. This will allow the running tool 53 to rotate relative to the sleeve 61. As the running tool 53 rotates, it moves upward. The shoulder 71 will contact the lip 67 to move the sleeve 61 upward also. This will cause the fingers 63 to disengage from the shoulders 41 on the dogs 33. The dogs 33 then spring outward, being pushed by the Belleville springs 49. The wickers 35 on the dogs 33 will engage the wickers 15 on the bore 13. Rotation of the drill pipe 59 can then be stopped.

The drilling rig will lift the casing 59 to apply tension. The dogs 33 will ratchet up the wickers 15 until the desired amount of tension has been achieved. The casing 17 located above the upper level of cement and mudline hanger will stretch. When the desired tension has been reached, which may be about 50,000 pounds, the operator slacks off on the casing 59.

The casing hanger 21 will not slide downward. Tension will remain in the casing 17 because the dogs 33 will be gripping the wellhead housing 11. Load will be transmitted through the shoulder 29 to the upper end 37. The radially outward load due to the force transmitted through shoulder 29 is much greater than the radially inward load produced between the two mating profiles of the wickers 15, 35. This occurs because of the larger surface area of the shoulder 29 than any shoulders of the wickers 15. This forms a uni-directional self-locking device capable of supporting substantial casing 17 in pressure end loads.

The operator will then rotate the drill pipe 59 until the running tool 53 completely disengages from the threads 55. The operator retrieves the drill pipe 59, running tool 53 and sleeve 61.

The operator will then lower a seal assembly 79 (FIG. 2) into the space between the casing hanger 21 and the wellhead housing bore 13. This space is located above the dogs 33 and above the shoulder 41. Seal assembly 79 may be of various types. The one shown in the embodiment is of a type that is shown in U.S. Pat. No. 4,665,979, Carl F. Boehm, Jr., issued May 19, 1987. After the seal assembly 79 has been set, this will be the position shown in FIG. 3.

The invention has significant advantages. The dogs allow tension to the placed in the casing to a precise degree. The running tool and sleeve provide a simple and effective means for retaining the dogs in a retracted position during the running-in procedure. There is no need to remove the blowout preventer when installing the casing hanger and seal assembly, reducing the chance for a blowout.

While the invention has been shown in only one of its forms, it should be apparent to those skilled in the art that it is not so limited but is susceptible to various changes without departing from the scope of the invention.

We claim:

1. In a wellhead housing having an axial bore, an apparatus for supporting a string of casing, comprising in combination:

a set of circumferential wickers formed in the bore of the wellhead housing;

a casing hanger having a lower end secured to the string of casing;

at least one load carrying member mounted around the exterior of the casing hanger;

the load carrying member having a set of circumferentially extending wickers formed on its exterior for engaging the wickers in the bore of the wellhead housing;

the exterior of the casing hanger having a recess for carrying the load carrying member, the recess having upper and lower shoulders, the upper shoulder facing downward and outward, the lower shoulder facing upward and inward and being parallel to the upper shoulder;

the load carrying member having upper and lower parallel ends for mating with the shoulders of the recess and being movable from a retracted to an extended position;

spring means for urging the load carrying member to the extended position;

retaining means for retaining the load carrying member in the retracted position until the casing hanger reaches a selected position in the wellhead housing, then for releasing the load carrying member to engage the wellhead housing to support the casing hanger; and a seal assembly installed between the casing hanger and wellhead housing above the load carrying member after the load carrying member engages the wellhead housing and the casing has been cemented.

2. In a wellhead housing having an axial bore, an apparatus for supporting a string of casing, comprising in combination:

a set of circumferential wickers formed in the bore of the wellhead housing;

a casing hanger having a lower end secured to the string of casing;

at least one load carrying member mounted around the exterior of the casing hanger;

the load carrying member having a set of circumferentially extending wickers formed on its exterior for engaging the wickers in the bore of the wellhead housing;

the exterior of the casing hanger having a recess for carrying the load carrying member, the recess having conical upper and lower shoulders, the upper shoulder facing downward and outward, the lower shoulder being parallel to the upper shoulder;

the load carrying member having parallel conical upper and lower ends for mating with the upper and lower shoulders of the recess and being movable from a retracted to an extended position;

spring means for urging the load carrying member to the extended position;

a running tool having means for releasably carrying the casing hanger for lowering the casing hanger into the wellhead housing;

means including a sleeve mounted to the running tool and extending around the casing hanger, the sleeve having means in engagement with the load carrying member for retaining the load carrying member in the retracted position until the casing hanger reaches a selected position in the wellhead housing;

means for moving the sleeve upward by movement of the running tool for releasing the load carrying member to engage the wellhead housing to support the casing hanger; and a seal assembly installed between the casing hanger and wellhead housing above the load carrying member after the load carrying member engages the wellhead housing and the running tool and sleeve are retrieved from the wellhead housing.

3. In a wellhead housing having an axial bore, an apparatus for supporting a string of casing, comprising in combination:

a set of circumferential wickers formed in the bore of the wellhead housing;

a casing hanger having a lower end secured to the string of casing;

at least one load carrying member mounted around the exterior of the casing hanger;

the load carrying member having a set of circumferentially extending wickers formed on its exterior for engaging the wickers in the bore of the wellhead housing;

the exterior of the casing hanger having a recess for carrying the load carrying member, the recess having conical upper and lower shoulders, the upper shoulder facing downward and outward, the lower shoulder being parallel to the upper shoulder;

the load carrying member having parallel conical upper and lower ends for mating with the upper and lower shoulders of the recess and being movable from a retracted to an extended position, the load carrying member having a shoulder formed on its upper end;

spring means for urging the load carrying member to the extended position;

a plurality of vertically extending flutes on the exterior of the casing hanger;

a sleeve extending around the casing hanger, and having at least one finger on its lower end which extends through one of the flutes into contact with the shoulder on the load carrying member, for preventing the load carrying member from moving outward from the retracted position until the casing hanger reaches a selected position in the wellhead housing;

means for moving the sleeve upward relative to the casing hanger for removing the finger from the shoulder of the load carrying member for releasing the load carrying member to engage the wellhead housing to support the casing hanger; and a seal assembly installed between the casing hanger and wellhead housing above the load carrying member after the load carrying member engages the wellhead housing and the casing has been cemented.

4. In a wellhead housing having an axial bore, an apparatus for supporting a string of casing, comprising in combination:

a set of circumferential wickers formed in the bore of the wellhead housing;

a casing hanger having a lower end secured to the string of casing;

at least one load carrying member mounted around the exterior of the casing hanger;

the load carrying member having a set of circumferentially extending wickers formed on its exterior for engaging the wickers in the bore of the wellhead housing;

the exterior of the casing hanger having a recess for carrying the load carrying member, the recess having conical upper and lower shoulders, the upper shoulder facing downward and outward, the lower shoulder facing upward and inward and being parallel to the upper shoulder;

the load carrying member having parallel conical upper and lower ends for mating with the upper and lower shoulders of the recess and being movable from a retracted to an extended position;

spring means for urging the load carrying member to the extended position;

a running tool rotatably secured to the casing hanger for lowering the casing hanger into the wellhead housing and for releasing the running tool from the casing hanger by rotation of the running tool relative to the casing hanger;

a sleeve mounted to the running tool and extending around the casing hanger, the sleeve having means on a lower end of the sleeve which contacts the upper end of the load carrying member for preventing the load carrying member from moving outward from the retracted position until the casing hanger reaches a selected position in the wellhead housing;

means including an upward facing shoulder on the running tool for moving the sleeve upward as the running tool rotates relative to the casing hanger, for disengaging the lower end of the sleeve from the load carrying member, allowing the load carrying member to engage the wickers in the wellhead housing to support the casing hanger with the casing; and a seal assembly installed between the casing hanger and wellhead housing above the load carrying member after the load carrying members engage the wellhead housing and the casing has been cemented.

5. In a wellhead housing having an axial bore, an apparatus for supporting a string of casing, comprising in combination:

a set of circumferential wickers formed in the bore of the wellhead housing;

a casing hanger having a lower end secured to the string of casing;

at least one load carrying member mounted around the exterior of the casing hanger;

the load carrying member having a set of circumferentially extending wickers formed on its exterior for engaging the wickers in the bore of the wellhead housing;

the exterior of the casing hanger having a recess for carrying the load carrying member, the recess having conical upper and lower shoulders, the upper shoulder facing downward and outward, the lower shoulder facing upward and inward and being parallel to the upper shoulder;

a plurality of vertically extending flutes on the exterior of the casing hanger;

the load carrying member having upper and lower parallel conical ends for mating with the shoulders of the recess and being movable from a retracted to an extended position;

the load carrying member having a shoulder formed on its upper end;

spring means for urging the load carrying member to the extended position;

a running tool secured by threads to the casing hanger for lowering the casing hanger into the wellhead housing and for releasing the running tool from the casing hanger by rotation of the running tool relative to the casing hanger;

a sleeve mounted to the running tool and extending around the casing hanger, the sleeve having at least one finger on its lower end which extends through one of the flutes and onto the shoulder on the upper end of the load carrying member for preventing the load carrying member from moving outward from the retracted position until the casing hanger reaches a selected position in the wellhead housing;

means including an upward facing shoulder on the running tool for moving the sleeve upward as the running tool rotates relative to the casing hanger, for disengaging the finger of the sleeve from the shoulder of the load carrying member, allowing the load carrying member to engage the wickers in the wellhead housing to support the casing hanger; and a seal assembly installed between the casing hanger and wellhead housing above the load carrying member after the load carrying member engage the wellhead housing and the casing has been cemented.

6. A method for supporting a string of casing in tension in a bore of a wellhead housing, comprising in combination:

providing a set of wickers in the bore of the wellhead housing;

securing a casing hanger to the string of casing;

mounting at least one load carrying member around the exterior of the casing hanger for movement from a retracted to an extended position, with the load carrying member having a set of circumferentially extending wickers formed on its exterior for engaging the bore of the wellhead housing;

the exterior of the casing hanger having a recess for carrying the load carrying member, the recess having conical upper and lower shoulders, the upper shoulder facing downward and outward, the lower shoulder facing upward and inward and being parallel to the upper shoulder;

the load carrying member having parallel upper and lower conical ends for mating with the shoulders of the recess;

biasing the load carrying member toward the extended position;

securing a running tool to the casing hanger;

mounting a sleeve to the running tool and around the casing hanger and retaining with the sleeve the load carrying member in the retracted position;

lowering the running tool and casing hanger into the wellhead housing;

cementing the casing;

rotating the running tool relative to the casing hanger and moving the sleeve upward, thereby releasing the load carrying member to engage the wellhead housing; and pulling upward on the running tool until selected tension in the casing is reached, with the tension being held by the engagement of the wickers of the load carrying member with the wickers of the bore; then releasing the running tool and sleeve from the casing hanger and retrieving the running tool and sleeve; then installing a seal assembly between the casing hanger and wellhead housing above the load carrying member.

* * * * *